US005225614A

United States Patent [19]

Harchar

[11] Patent Number: 5,225,614

[45] Date of Patent: Jul. 6, 1993

[54] EXTRACTION APPARATUS FOR REMOVAL OF A BULLET FROM A MUZZLE-LOADING GUN

[76] Inventor: John Harchar, 25 Carlton Ave., Monroe Township, Spotswood, N.J. 08884

[21] Appl. No.: 898,002

[22] Filed: Jun. 16, 1992

[51] Int. Cl.[5] ..... F41C 27/00

[52] U.S. Cl. ..... 42/90; 81/3.05

[58] Field of Search ..... 42/51, 90; 81/3.05

[56] References Cited

U.S. PATENT DOCUMENTS 4,407,086 10/1983 Hasselmann ..... 42/90

*Primary Examiner*—Stephen C. Bentley

*Attorney, Agent, or Firm*—Louis E. Marn

[57] ABSTRACT

An extraction apparatus for removal of a bullet or musket ball from the barrel of a muzzle-loading gun, comprisng an articulating lever assembly in which a bracing member and a removal member are secured in articulating fashion, the bracing member being cooperative with the muzzle of the muzzle-loading gun to permit the passage therethrough of the ramrod, the removal member operably attached to the bracing member by means of an articulating assembly, the removal member having split rings positioned within a chamber alignable with the bracing member and ramrod, the split rings engaging the ramrod and removing the ramrod from the muzzle through the articulating action of the lever assembly.

5 Claims, 1 Drawing Sheet

EXTRACTION APPARATUS FOR REMOVAL OF A BULLET FROM A MUZZLE-LOADING GUN

BACKGROUND OF INVENTION (1) Field of Invention

This invention relates to weapons and in particular to muzzle-loading guns and an apparatus for removing a musket ball undesirably lodged in the breech of a muzzle-loading gun.

(2) Description of the Prior Art

Muzzle-loading guns had been relegated to antique status as a result of the development of modern rifles and carbines which provide for both automatic and semi-automatic operation. However, muzzle-loading guns have developed a resurgence as a result of collector's interest, target tournaments which are limited to the use of muzzle-loading guns and in many states, a special hunting season limited to the use of muzzle-loading guns.

In operation, a muzzle loading gun is loaded through the muzzle of the barrel as opposed to the breech load utilized in more modern weapons. A powder charge is first poured down the barrel into the breech of the muzzle loading gun. A projectile in the form of a musket ball is then forced down the barrel into the breech. A ramrod which is removably contained in a receptacle extending underneath the barrel of the muzzle-loading gun is utilized for tapping the powder down and for forcing the musket ball down the barrel into tight contact with the powder.

An individual utilizing a muzzle-loading gun would also carry a ball starter. The ball starter includes a grip from which a bar or shaft extends and obtains its name from the fact that the ball starter is normally spherical. In normal operation, the musket ball is seated in the barrel, the musket ball is then thrust a short distance into the barrel by the shaft of the ball starter. The ramrod is then utilized to position the musket ball in the breech, in tight contact with the powder. The musket ball is in a tight sliding fit with the barrel. The musket ball normally has a partial flat surface formed on its circumference during manufacture which which must be oriented to face axially outwardly from the barrel when the ball is positioned adjacent the powder.

Frequently, a musket ball is undesirably locked in the breech. This can occur as a result of damp or ineffective powder or the total lack of powder as a result of a lapse of procedure on the part of the user. The musket ball must therefore be removed from the breech. This is accomplished by positioning a screw jag tool on the threaded inner end of the ramrod. The ramrod is extended down the barrel so that the screw jag tool can engage the flat circumferential surface of the musket ball. The screw jag tool is then screwed into the musket ball by pressing on the ramrod and turning it. Once the screw jag tool is secured to the musket ball, the ramrod must be removed.

Difficulty in removing the ramrod arises from the fact that the ramrod only extends a short distance out of the barrel of the muzzle-loading gun and is of a relatively thin diameter thus making it difficult to grip and to overcome the frictional drag created between the musket ball and the interior cylindrical surfaces of the barrel. One option when a musket ball becomes undesirably lodged is to withdraw from the hunt or target range and place the end of the ramrod in a mechanical vise and then pull the muzzle-loading gun and its barrel off of the ramrod. This solution is unacceptable since it interrupts a hunter's endeavor or terminates the endeavor and requires the hunter to seek out mechanical aids or a gunsmith to aid in dislodging the musket ball.

There have been past attempts to provide a solution to the problem which would allow the user to remove the undesirably lodged musket ball in the field and resume the hunt or the target practice without any lengthy delay or interruption. To be viable, these solutions must present a tool which is lightweight, cooperative with the ramrod and easily stored or carried in the user's powder bag or musket ball bag. Hasselmann in U.S. Pat. No. 4,407,086 made certain modifications to the ball starter and ramrod to provide for the ball starter as a handle for slidably removing the ramrod and attached musket ball. While Hasselmann's solution met the requirements for a lightweight and easily-carried tool, it still required the user to use his own muscle power to withdraw the ramrod and overcome the friction between the musket ball and the interior wall of the barrel.

Applicant's solution is a lightweight, compact, articulating lever assembly which would be positioned over the barrel and ramrod once the ramrod had been secured to the musket ball. The articulating lever assembly would engage the ramrod by a pair of split rings slidably securable to the ramrod and which would successively withdraw a portion of the ramrod from the barrel with successive lever action.

It will be futher appreciated upon review of the detailed specification that the apparatus as disclosed by Applicant allows the user to withdraw the ramrod and musket ball from the barrel of the muzzle-loading gun without having to position the user's body or arm in substantial alignment with the barrel of the weapon.

OBJECTS OF THE INVENTION

An object of the present invention is to provide for a novel extraction apparatus for the removal of a bullet from a muzzle-loading gun in which the extraction apparatus provides the user with a means for supplying leverage to the ramrod for its removal.

Another object of the present invention is to provide for a novel extraction apparatus which is cooperative with the muzzle of the muzzle-loading gun in supplying leverage to the ramrod for its removal.

A still further object of the present invention is to provide for a novel extraction apparatus in which a bracing block and a removal block are secured in an articulating manner, the removing block having split rings positioned therein for engagement with the ramrod.

A still further object of the present invention is to provide for a novel extraction apparatus which is both compact and lightweight and easy to carry in the field.

SUMMARY OF THE INVENTION

The present invention is directed to an extraction apparatus for the removal of a bullet from a muzzle-loading gun, the extraction apparatus being comprised in an articulating lever assembly in which a bracing member and a removal member are secured in articulating fashion, the bracing member designed to cooperate with the muzzle of the muzzle-loading gun to permit the passage therethrough of the ramrod. The removal member is operably attached to the bracing member by means of an articulating assembly, the removal member having split rings positioned within a chamber alignable with the bracing member and ramrod, the split rings engaging the ramrod and removing the ramrod from the muzzle through the articulating action of the lever assembly.

BRIEF DESCRIPTION OF THE DRAWINGS

These and other objects of the present invention will be better understood when taken in light of the following illustrations wherein.

DETAILED DESCRIPTION OF THE DRAWINGS

Figure 1:
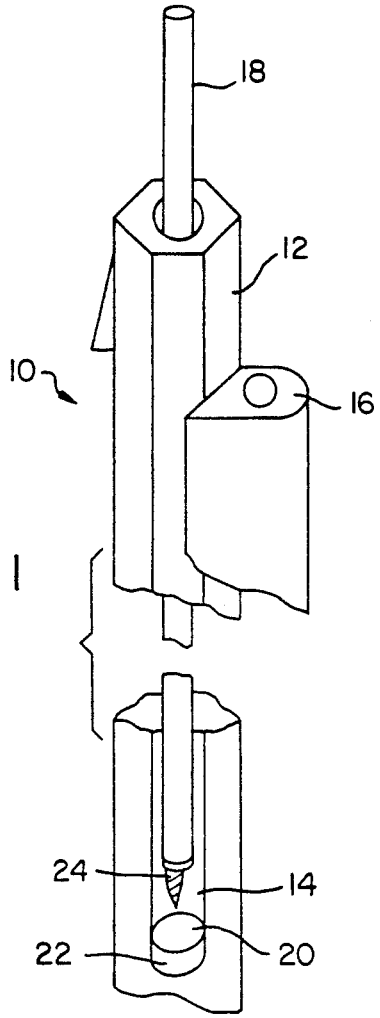
FIG. 1 is a side elevational view with partial section illustrating the construction of the muzzle-loading gun and the positioning of a ramrod for removal of a musket ball.

FIG. 1 is a side elevational view with partial section of a typical muzzle-loading gun. Muzzle-loading gun 10 includes a barrel 12 having a muzzle portion 13, a breech 14, and a fore-stock receptacle 16. Fore- stock receptacle 16 is for receipt of the ramrod 18 when it is not in use. Fore-stock receptacle 16 would extend the underlength of the barrel 12.

FIG. 1 illustrates the use of the ramrod 18 in removing a musket ball 20 positioned in breech 14. Musket ball 20 would have been positioned in breech 14 by use of the ramrod once the powder 22 had been positioned in the breech. The ramrod is being utilized with screw jag tool 24 to remove the musket ball 20. Screw jag tool 24 is a conical shape screw securable to the end of ramrod 18. In normal operation, screw jag tool 24 is secured by either threaded engagement with ramrod 18 or a key and pin type arrangement.

The screw jag tool 24 will engage musket ball 20 and the user would then turn or twist ramrod 18 so that the external threads of the screw jag tool would penetrate musket ball 20 which most oftentimes is made of lead. Once the screw jag tool has securely engaged musket ball 20, ramrod 18 and musket ball 20 must be withdrawn from the barrel. Since musket ball 20 is in tight engagement with the interior walls of the barrel, the user must overcome this friction in removing the musket ball with ramrod 18. Typically, the extension of ramrod 18 from barrel 12 is not of such length to provide the user with any significant leverage in removing musket ball 20.

Figure 2:
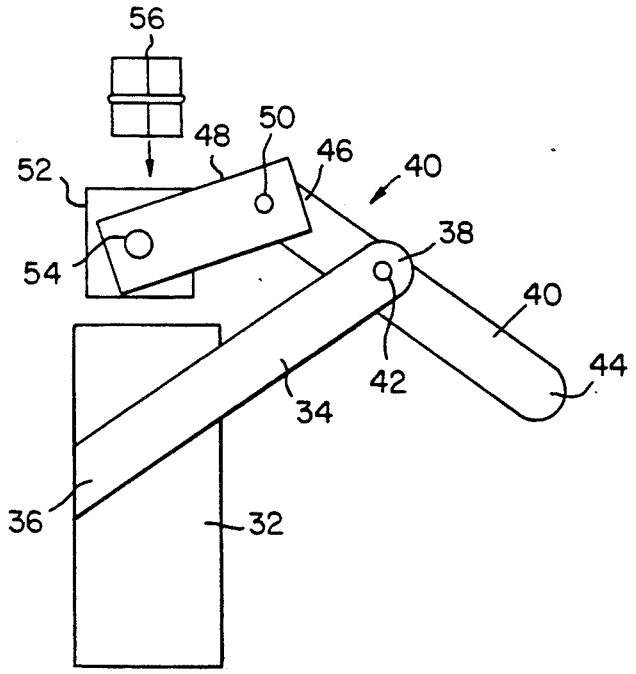
FIG. 2 is a side elevational view of the extraction apparatus.

FIG. 2 is a side elevational view illustrating Applicant's extraction apparatus 30 which provides the muzzle-loading gun user with the ability to impart leverage on the ramrod to remove the ramrod and musket ball from the barrel of the muzzle-loading gun. Extraction apparatus 30 includes a bracing block 32 which is designed to engage barrel 12 of the muzzle-loading gun. A pair of lever arm supports 34 have their first ends 36 secured to the lateral sides of bracing block 32. Lever arm supports 34 extend in an angular upward manner with the second end 38 of lever arm supports 34 in pivotal engagement with lever arm 40 at pivot point 42.

Lever arm 40 has a first handle end 44 and a second end 46 which is pivotly secured to two swivel arms 48 about pivot point 50. Pivot arms 48 are in turn pivotly secured to removal block 52 about pivot point 54. Removal block 52 has a chamber defined therein for receipt of a pair of split rings 56 which frictionally engage the extending end of ramrod 18. In this configuration, downward pressure on handle end 44 of lever arm 40 results in the movement of removal block 52 upwardly, and away from bracing block 32. The articulating motion of lever arm 40 in this manner, results in the removal of the ramrod 18 and musket ball 20 from barrel 12 of muzzle-loading gun 10.

Figure 3:
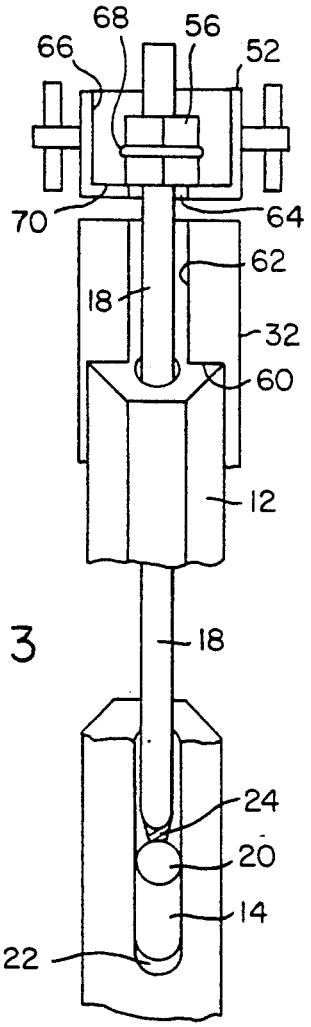
FIG. 3 is a side elevational view with partial section illustrating the extraction apparatus in cooperation with a musket in the removal of a ramrod and musket bullet.

The manner in which the removal or extraction of ramrod 18 is accomplished is better understood with reference to FIG. 3 which illustrates a side elevational view in partial section of extraction apparatus 40 engaged with barrel 12 of muzzle-loading gun 10. In FIG. 3, ramrod 18 has been inserted into barrel 12 and rotated or twisted such that screw jag tool 24 has engaged musket ball 20. The upper portion of ramrod 18 extends outwardly from barrel 12. Bracing block 32 has been positioned over barrel 12 such that barrel 12 is engaged within a recessed chamber 60 with ramrod 18 passing upwardly through bracing block 32 through channel 62.

Removal block 52 is pivotly positioned over bracing block 32 such that the upper end of ramrod 18 extends through aperture 64 which is in alignment with channel 62 and bracing block 32. In this position, the upper portion of ramrod 18 is positioned within recessed chamber 66 of removal block 52. Split rings 56 are then inserted into recessed chamber 66 and positioned about the circumference of ramrod 18 and positioned by means of a securing ring 68. The circumference of split rings 56 when so positioned is greater than the circumference of aperture 64 in removal block 52.

Thus, when downward pressure is exerted on handle end 44 of lever arm 40, the articulating action about pivot point 42, 50 and 54 causes removal block 52 to move upwardly and away from bracing block 32. The bottom interior wall 70 of recessed chamber 66 of removal block 52 will engage split rings 56 which in turn will simultaneously frictionally engage the circumference of ramrod 18 and move ramrod 18 the corresponding distance upwardly within barrel 12. Upward articulating action on handle end 44 of lever arm 40 causes removal block 52 to move downwardly toward bracing block 32. The frictional engagement of split rings 56 about the circumference of ramrod 18 is released during this downward movement. Repeating the downward pressure on handle end 44 of lever arm 40 causes the repeat of the articulating action with split rings 56 frictionally engaging the circumference of ramrod 18 and continuing its movement upwardly out of barrel 12 with musket ball 20 attached thereto.

This sequence of articulating action is repeated until ramrod 18 with musket ball 20 attached thereto is substantially removed from the barrel 12. The user can then correct the deficiency with respect to the musket ball or powder, remove the screw jag tool 24 from ramrod 18, and reload the muzzle-loading gun for use. The entire procedure can be accomplished efficiently and expeditiously in the field without the need for the user to retire from the hunt or competition to seek assistance or other complicated devices for removal of the musket ball.

The extraction apparatus can be made of any suitable material which is lightweight, yet strong enough to accept the loads encountered through the articulating action of the apparatus. An ordinary wood prototype has functioned efficiently; however, an extraction apparatus constructed of polycarbonate would provide the durability and weight tolerances which would be acceptable by a muzzle-loading gun user transporting the extraction apparatus with him in the field.

While the invention has been described with reference to its preferred embodiment thereof, it will be appreciated by those of ordinary skill in the art that various changes can be made in the process and apparatus without departing from the basic spirit and scope of the invention.

What is claimed is:

1. Extraction apparatus cooperative with the muzzle and ramrod of a muzzle-loading gun for the extraction of a bullet or musket ball from a barrel of said muzzle-loading gun, said extraction apparatus comprising:

a bracing member engageable with said muzzle of said muzzle-loading gun, said bracing member having a throughbore alignable with said muzzle of said muzzle-loading gun for the passage therethrough of said ramrod;

a removal member alignable with said bracing member, said removal member having a throughbore formed therein, alignable with said throughbore of said bracing member for the passage therethrough of said ramrod;

an articulating lever means in communication with said bracing member and said removal member for reciprocating movement of said removal member relative to said bracing member;

a frictional engaging means for the selective engagement and selective release about a circumferential surface of said ramrod responsive to said articulated lever means, said frictional engaging means positioned within said throughbore of said removal member.

2. The extraction apparatus as defined in claim 1 wherein said articulating lever means comprises a pair of rigid support arms having a first end and a second end, said first end rigidly secured to said bracing member; a lever arm, having a first end and a second end, said first end of said lever arm serving as a handle, said second end of said lever arm pivotly secured to a pair of swivel arms, said swivel arms being pivotly secured to said removal member, said lever arm being pivotly secured to said second end of said support arms intermediate to said first end and said second end of said lever arm.

3. The extraction apparatus as defined in claim 1 wherein said frictional engagement means comprises a split ring positioned in said throughbore of said removal member, said split ring having an inner diameter complimentary to the diameter of said ramrod, said split ring frictionally engaging said circumferential surface of said ramrod through operation of said articulating lever means causing reciprocating movement of said removal member away from said bracing member, said split rings disengaging the circumferential surface of said ramrod through operation of said articulating lever means causing reciprocating movement of said removal member towards said bracing member.

4. The extraction apparatus as defined in claim 1 wherein said throughbore of said bracing member is formed at one end thereof, a widened bore for engagement of said bracing member about said muzzle of said barrel of said muzzle-loading gun.

5. The extraction apparatus as defined in claim 3 wherein repetitive activation of said articulating lever means creating said reciprocating movement of said removal member relative to said bracing member repeatedly resets said split rings in engagement with said ramrod at a location on said ramrod below the previous frictionally-engaged location.

* * * * *